US005240048A

United States Patent [19]

Diehl

[11] Patent Number: 5,240,048

[45] Date of Patent: Aug. 31, 1993

[54] ARRANGEMENT FOR MONITORING THE FILLING ELEMENTS OF FILLING MACHINES

[75] Inventor: Egbert Diehl, Hackenheim, Fed. Rep. of Germany

[73] Assignee: Seitz Enzinger Noll Maschinenbau Aktiengesellschaft, Mannheim, Fed. Rep. of Germany

[21] Appl. No.: 726,385

[22] Filed: Jul. 5, 1991

[30] Foreign Application Priority Data

Jul. 11, 1990 [DE] Fed. Rep. of Germany ..... 4022142

[51] Int. Cl.[5] ..... B65B 31/00

[52] U.S. Cl. ..... 141/39; 141/89; 141/51; 73/49.03

[58] Field of Search ..... 141/39, 40, 89, 90, 141/91, 92, 64, 97, 51, 83, 95, 48, 59, 63, 197, 137, 390; 73/49.2 A, 700, 714, 37, 49.3, 49.2 R, 49.2 J, 705, 715, 730; 137/557

[56] References Cited

U.S. PATENT DOCUMENTS 1,143,338 6/1915 Wesener ..... 73/715
3,805,594 4/1974 Hayashi ..... 73/49.2 R
3,837,215 9/1974 Massage ..... 73/49.3
3,987,664 10/1976 Hass et al. ..... 73/49.2 R
4,667,506 5/1987 Jenkins et al. ..... 73/49.2 R
4,757,718 7/1988 Fox ..... 73/714

*Primary Examiner*—Henry J. Recla
*Assistant Examiner*—David J. Walczak
*Attorney, Agent, or Firm*—Robert W. Becker & Associates

[57] ABSTRACT

An arrangement for monitoring the filling elements of a filling machine that, for filling containers with a liquid filling material, has a plurality of such filling elements disposed on a rotating rotor. Each filling element has a closeable bell-shaped portion for accommodating a container that is to be filled. The bell-shaped portion is designed to operate at a processing pressure of a gaseous or vaporous medium, with the processing pressure being other than ambient pressure. To monitor a satisfactory operation, a respective pressure gauge is provided on each filling element and is responsive to the pressure in the pertaining bell-shaped portion of that filling element. At least one sensor is provided via which the pressure gauge produces an electrical signal if the processing pressure in the bell-shaped portion deviates from the ambient pressure.

20 Claims, 3 Drawing Sheets

ARRANGEMENT FOR MONITORING THE FILLING ELEMENTS OF FILLING MACHINES

BACKGROUND OF THE INVENTION

The present invention relates to an arrangement for monitoring the filling elements of a filling machine that, for filling containers, especially bottles, with a liquid filling material, has a plurality of such filling elements disposed on a rotating rotor, with each of the filling elements having a closeable bell-shaped portion for accommodating a container that is to be filled, with the bell-shaped portion being designed to operate at a processing pressure of a gaseous or vaporous medium, with this processing pressure being other than ambient pressure, and preferably being greater than ambient pressure.

Especially to dispense liquid material into containers, especially bottles, in an aseptic or sterile manner, a filling machine is known (U.S. Pat. No. 5,031,673, Clüsserath) that has a plurality of filling elements on a rotor that rotates about a vertical machine axis or axis of rotation; each filling element, on a housing, has a downwardly open bell-shaped portion that can be closed off by a plate that is provided below the respective filling element, can be raised and lowered by a lifting mechanism, and forms a support surface for the respective container that is to be filled, with the bell-shaped portion being adapted to be acted upon by the pressure of a gaseous or vaporous medium. The bell-shaped portions are embodied in such a way that even in a closed state, each bell-shaped portion completely accommodates the container that is to be filled. With the aseptic or sterile dispensing, the medium that is supplied under pressure to the respectively closed bell-shaped portion is a sterilization medium in the form of saturated steam that is introduced into the respective bell-shaped portion during a sterilization phase, i.e. is introduced when the filling element that is provided with this bell-shaped portion has, after passing the container inlet, reached a certain angular position. For the desired sterilization effect, it is necessary that an overpressure for the sterilization medium builds up in the interior of the respectively closed bell-shaped portion, with this overpressure being greater than a prescribed minimum pressure. For example, when a defective closing of a bell-shaped portion occurs, for example due to excessive wear of sealing elements or the like, this minimum pressure for the sterilization or processing medium is not ensured.

In addition to or instead of supplying the bell-shaped portions with a sterilization medium that is under pressure, it is, for example, also conceivable, for other process reasons, to supply the closed bell-shaped portions with an over-pressure of some other medium, for example with a pressure of $CO_2$ gas, or with an underpressure, whereby the desired effect and quality of such a processing is also a function of whether or not the respective processing pressure deviates from the ambient pressure by a prescribed minimum value.

It is therefore an object of the present invention to provide an arrangement for monitoring the filling elements of a filling machine of the aforementioned general type, with such arrangement, at minimal structural expense, enabling a reliable monitoring of the filling elements with regard to a proper processing temperature in the closed bellshaped portions.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
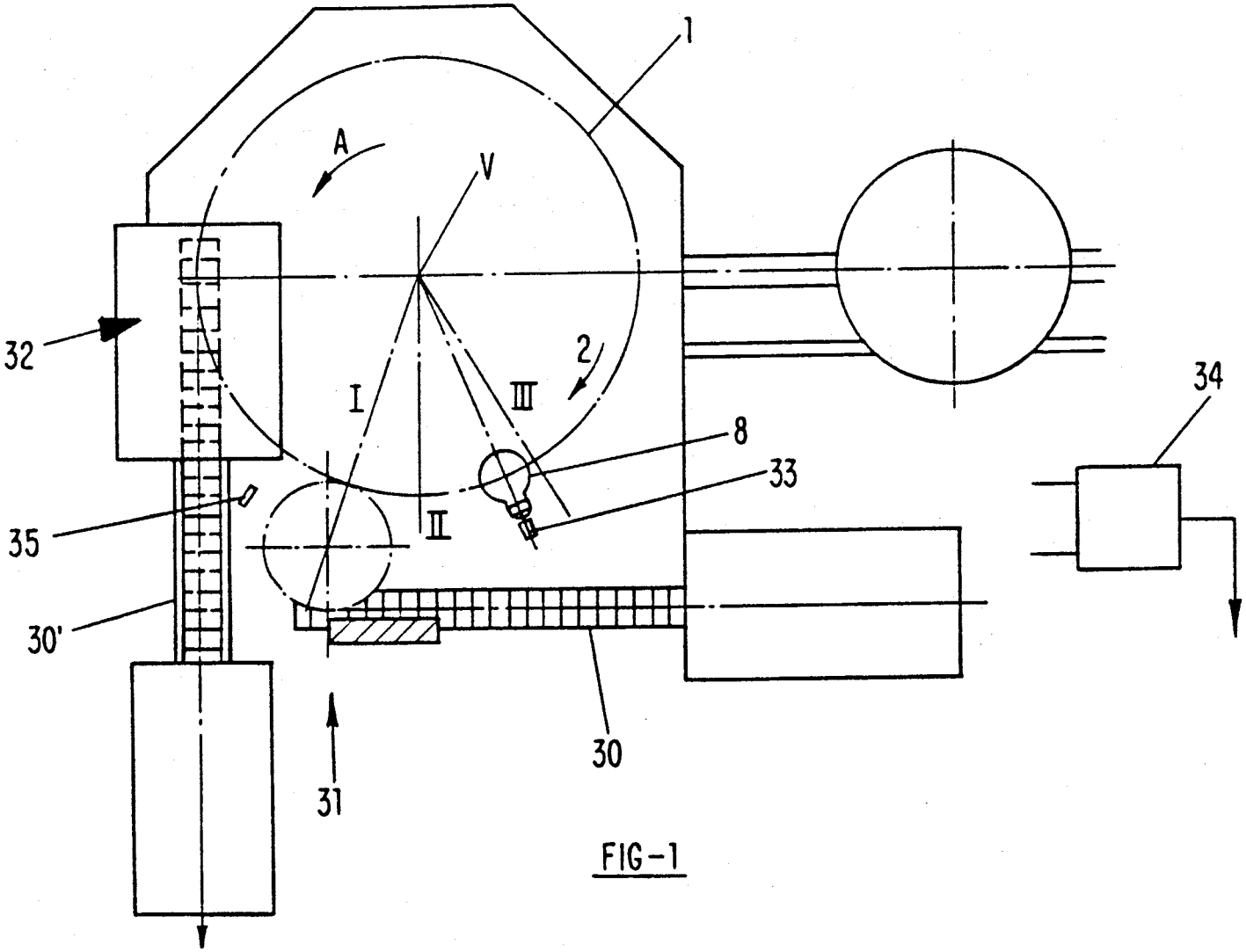
FIG. 1 is a top view of one exemplary embodiment of the inventive bottle filling machine that is suitable for dispensing liquid into bottles in an aseptic manner.
Figure 2:
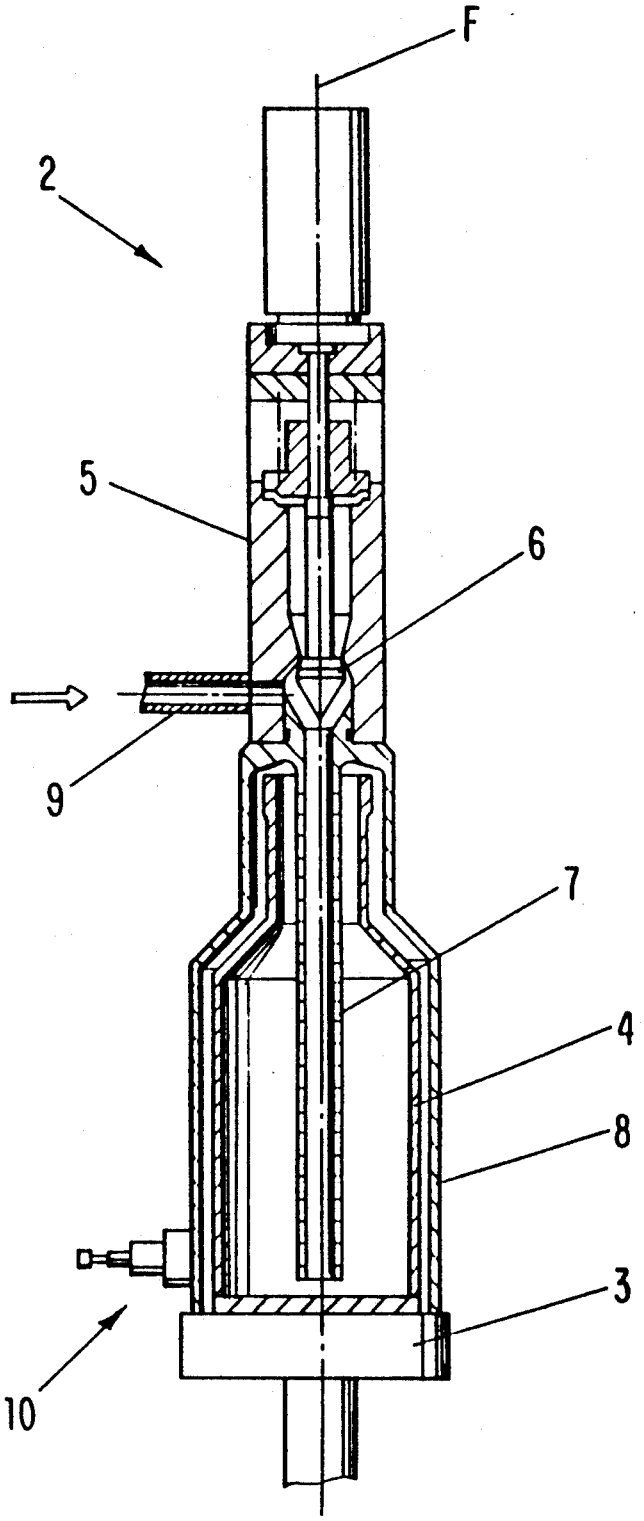
FIG. 2 is a very simplified illustration of a filling element of the filling machine of FIG. 1 showing a bellshaped portion together with a bottle that is resting on a bottle plate and is completely accommodated by the closed bell-shaped portion.

The arrangement of the present invention is characterized primarily by: a respective pressure gauge that is provided on each of the filling elements and is responsive to the pressure in the pertaining bell-shaped portion of such filling element; and at least one sensor, via which the pressure gauge produces an electrical signal if the processing pressure in the bell-shaped portion deviates from the ambient pressure.

With the inventive arrangement, it is possible to monitor the satisfactory operation of the filling elements, i.e. the bell-shaped portions of these filling elements, whereby whenever at a prescribed angular position downstream of the bottle inlet when viewed in the direction of rotation of the rotor, a bell-shaped portion does not have the prescribed processing pressure, for example a prescribed minimum pressure, a signal that registers the defect or failure of the filling element or its bell-shaped portion is generated by the pressure gauge and the sensor. This signal can then effect, for example, a visual and/or audible indication of a disruption of operation and/or a shutdown of the filling machine and/or a blocking of the defective filling element, etc.

The pressure gauges that respond to the pressure in the interior of the respective bell-shaped portion are provided either on the housing of the respective filling element or on an element that is connected with this housing, with it being understood that a connection or communication exists between the pressure gauge, i.e. between the part of the pressure gauge that receives the pressure, and the interior of the bell-shaped portion. In the most straightforward situation, the respective pressure gauge is provided on the bell-shaped portion itself.

The at least one sensor is preferably shared by all of the pressure gauges. This sensor is then disposed at that angular position of the rotational movement of the rotor at which the processing pressure in the bell-shaped portions is to be monitored. In such a case, each pressure gauge has a control section that when ambient pressure prevails in the bell-shaped portion has a first position relative to the filling element or the bell-shaped portion, and when processing pressure prevails in the bell-shaped portion has a second position that differs from the first position, so that the sensor delivers a signal that is respectively a function of the positioning of the control section.

The use of at least one sensor that is shared by all of the pressure gauges has the considerable advantage that only an extremely low number of sensors (and in the extreme case only a single sensor) are required, and furthermore the expenditure for signal lines is considerably reduced.

The inventive arrangement is suitable not only for monitoring the overpressure of a sterilization medium, but also for monitoring the overpressure, and also underpressure, of other processing media in the closed bell-shaped portions.

Further specific features of the present invention will be discussed in detail subsequently.

DESCRIPTION OF PREFERRED EMBODIMENTS

Referring now to the drawings in detail, the bottle filling machine illustrated in FIG. 1 essentially comprises a rotor 1 that rotates in the direction of the arrow A about a vertical axis V, with the rotor 1, in a customary manner, being provided at its periphery with a plurality of filling elements 2 that are distributed at uniform angular distances about the axis of rotation V. Disposed below the filling elements 2 are respective bottle plates 3 that can be raised and lowered in the vertical filling element axis F in a customary manner via a non-illustrated lifting mechanism. The upper side of each bottle plate 3 forms a support surface for the bottle 4 or other container that is to be filled. Each filling element 2 has a housing 5 in which is provided, among other things, the liquid flow valve 6, a filling tube 7 that projects beyond the underside of the housing 5, as well as a bell-shaped portion 8 that also projects beyond the underside of the housing 5, concentrically surrounds the filling tube 7, i.e. the filling element axis F, and is open at the underside. The bell-shaped portion 8 is embodied in such a way that it can completely accommodate the respective bottle 4 that rests upon the bottle plate 3, even in the uppermost raised position of the bottle plate 3. Furthermore, the bell-shaped portion 8 as well as the bottle plate 3 are embodied in such a way that in its uppermost raised position, the bottle plate 3 tightly seals off the interior of the bottle-shaped portion 8 toward the outside, so that it is then possible, in order to sterilize the bottles 4 prior to introducing the liquid filling material therein, to supply to the bell-shaped portion 8, which is closed off by the pertaining bottle plate 3, a sterilization medium, for example saturated steam, via a line 9 in such a way that this sterilization medium has a prescribed overpressure (treatment or processing pressure) in the bell-shaped portion 8.

Provided on the bell-shaped portion 8 of each filling element 2 is a pressure gauge 10 that has a ring 13 that is provided at an opening 11 in the peripheral wall 12 of the bell-shaped portion 8; this ring 13 concentrically surrounds a horizontal longitudinal axis L that extends perpendicular to the filling element axis V. At that end disposed closest to the interior of the bell-shaped portion 8, the ring 13 is provided with an annular wall portion 14 that extends radially inwardly and encircles a circular opening 15.

Inserted into the ring 13 from that side that is remote from the interior of the bell-shaped portion 8 are two housing members 16 and 17, namely the essentially sleeve-like housing member 16 one end of which is provided with a radially outwardly projecting flange 18, and the hood-like outer housing member 17, the open end of which is similarly provided with a radially projecting flange 19. The outer housing member 17 concentrically surrounds the inner housing member 16 as well as the longitudinal axis L. The outer peripheral surfaces of the flanges 18 and 19 of the housing member 16 and 17 respectively are circular and rest against the inner surface of the ring 13. The periphery of a diaphragm 20 that is made of flexible material, for example rubber or flexible plastic, is clamped between the flange 18 of the inner housing member 16 and that side of the wall portion 14 of the ring 13 that is remote from the interior of the bell-shape portion 8. This clamping of the diaphragm 20 is achieved due to the fact that the flange 19 presses against the flange 18 and is secured in the ring 13 by a retaining ring 21. The diaphragm 20, which is tightly clamped in at its periphery, is tightly secured in its central region to one end of a stem 22, the axis of which coincides with the longitudinal axis L; thus, the opening 15 encircled by the wall portion 14 is tightly closed off by the diaphragm 20. A portion 22' of the stem 22 having a greater cross-sectional configuration is displaceable in the direction of the longitudinal axis L in a glide or slide sleeve 23 that is held on the inner housing member 16.

Figure 3:
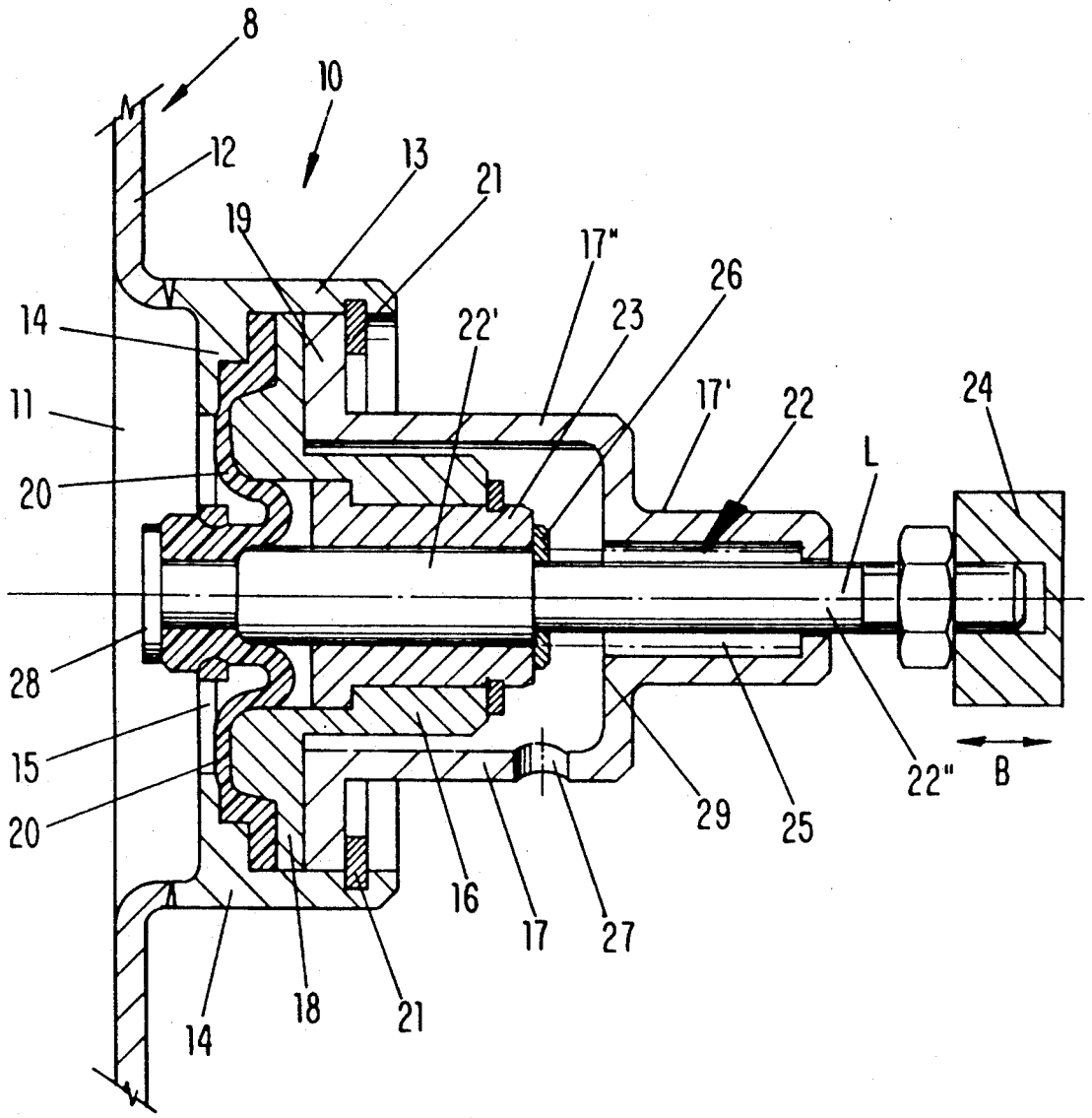
FIG. 3 is an enlarged cross-sectional illustration of a pressure gauge provided on the bellshaped portion of each filling element.

As can be seen from FIG. 3, both the housing member 17, as well as the housing member 16 that is surrounded thereby, extend beyond that side of the ring 13 that is remote from the interior of the bell-shaped portion 8. That end of the housing member 17 remote from the interior of the bell-shaped portion 8 has a portion 17' of reduced cross-sectional area. A portion 22'' of the stem 22 having a cross-sectional area that is less than that of the portion 22' projects beyond that end of the housing member 17, i.e. the portion 17' thereof, that is remote from the interior of the bell-shaped portion 8, and is provided at this end with a contact or trip cam 24 that, as indicated by the double arrow B in FIG. 3, is disposed on that end of the stem 22 that is remote from the interior of the bell-shaped portion 8 in such a way that it is adjustable in the direction of the longitudinal axis L.

Provided in the interior of the housing member 17, and in particular in the portion 17' thereof, is a compression spring 25 that surrounds that part of the stem 22 that is disposed there. That end of the spring 25 that is remote from the interior of the bell-shaped portion 8 rests against a surface C of the portion 17' that surrounds the stem 22 in a ring-like manner, while the other end of the spring 25 rests against a ring 26 that is placed upon the stem 22, with that side of the ring 26 that is remote from the compression spring 25 resting against a shoulder-like offset that is formed at the transition zone between the portions 22' and 22''.

An opening 27 is provided in the housing member 17 to vent the interior surrounded by this housing member.

FIG. 3 shows the stem 22 and trip cam 24 in a starting position in which the ring 26 is supported against that end face of the slide sleeve 23 that is remote from the interior of the bell-shaped portion 8, with the compression spring 25 being tensioned or compressed. If the bell-shaped portion 8 is closed off in the aforementioned manner by the pertaining bottle plate 3 that is disposed therebelow, and if the bell-shaped portion 8 is pressurized, the resulting over-pressure acts via the opening 15 in particular upon that end of the stem 22 that is provided in the vicinity of the opening 11 and forms an enlarged surface 28, so that when the force that acts upon the surface 28 exceeds the force of the compression spring 25, the stem 22 is shifted out of its starting position against the effect of the compression spring 25 and in the direction of the longitudinal axis L toward the right when viewing the position illustrated in FIG. 3. During this displacement out of the starting position, the maximum stroke of the stem 22 is fixed due to the fact that the ring 26 comes to rest against an annular portion 29 of the inner surface of the housing member 17 that surrounds the stem 22, and in particular at that location where the larger diameter portion 17'' merges with the smaller diameter portion 17'.

The longitudinal axes L of the pressure gauges 10 of all of the filling elements 2 are each oriented in the same manner relative to the axis of rotation V; in other words, in the illustrated embodiment, the pressure gauges 10, relative to the axis of rotation V, are disposed radially outwardly on the respective bell-shaped portion 8, and in particular in such a way that the longitudinal axis L extends radially relative to the axis of rotation V.

The bottles 4 are supplied to the filling machine via a transport mechanism 30, with the bottles successively passing via a bottle inlet 31 onto a bottle plate 3 of the rotor 1, which rotates about the axis of rotation V.

At an outlet 32, the filled bottles 4 are transferred from the rotor 1, i.e. from the bottle plates 3, onto a transport mechanism 30' that carries the filled bottles away.

In FIG. 1, the reference symbol "I" indicates the respective angular position of a filling element 2 as well as the pertaining bottle plate 3 when a bottle 4 is transferred thereto. The reference symbol "II" indicates that angular position at which, with the respective bell-shaped portion 8 being closed, the supply of the sterilization medium at overpressure into the respective bell-shaped portion 8 for sterilization of the bottle 4 disposed therein is initiated. The reference symbol "III" indicates the angular position in which the sterilization phase that precedes the actual filling phase is terminated and at which point the actual filling of the respective bottle 4 with the filling material is then initiated.

A satisfactory sterilization of the bottles 4 is ensured only when during the treatment with the sterilization medium the required overpressure of the sterilization medium is built up in the interior of each bell-shaped portion 8, and for this purpose in particular the respective bell-shaped portion 8 is properly closed off by the bottle plate 3. Once the desired overpressure has built up in the interior of a closed bell-shaped portion 8, the stem 22 of the pertaining pressure gauge 10 is shifted radially outwardly against the effect of the compression spring 25 out of the starting position, so that a proximity switch 33 that is disposed ahead of the angular position III is engaged by the trip cam 24 of the bell-shaped portion 8 that is moving past it and delivers to a control mechanism 34 a signal that confirms that an overpressure exists in this bell-shaped portion 8. However, if an overpressure of the sterilization medium cannot build up to a prescribed level in a bell-shaped portion 8, the stem 22 of the pressure gauge 10 of this bell-shaped portion remains in the starting position, and as it moves past the sensor 33, the latter is not engaged and does not deliver a signal to the control mechanism 34. This control mechanism then generates a malfunction signal that indicates, for example, the operational disruption, preferably accompanied by an indication of the position of the defective filing element 2 or bell-shaped portion 8, so that the filling machine can be stopped and the defect can be eliminated. The stopping of the filling machine can also be effected automatically by the malfunction signal delivered by the control mechanism 34. Furthermore, it would also be possible, despite the presence of the malfunction signal, to maintain the filling operation and to merely arrest the liquid flow valve 6 of the filing element 2 with the defective bell-shaped portion 8 in the closed position. Those bottles that are transferred at the inlet 31 to the filling element 2 having the defective bell-shaped portion 8 are automatically ejected or separated out after the outlet 32 and preferably prior to the closure or capping mechanism that follows the filling machine; these bottles can then be resupplied to the transport mechanism 30 as empty bottles 4.

The minimum pressure at which the pressure gauge 10 becomes operative, in other words at which the stem 22 is moved out of the starting position against the compression spring 25 into a position that indicates the presence of the overpressure, is, for example, approximately 1.7 bar.

In order to be able to check whether or not the pressure gauge 10 is operating properly, it is possible to provide at a further angular position at which no overpressure exists in the interior of the bell-shaped portion 8 that is moving past this position, for example an angular position between the outlet 32 and the inlet 31, a further sensor 35 that, for example, is also a proximity switch and is connected to the control mechanism 34. If the pressure gauges 10 are operating properly, this sensor 35 is not engaged. However, if, for example due to a failure of the compression spring 25, the stem 22 of a pressure gauge 10 remains in the position that indicates that a pressure is present, the sensor 35 is engaged, which then similarly leads to a malfunction signal at the control mechanism 34.

The present invention has been described in conjunction with one specific embodiment. However, it is to be understood that variations or modifications are possible while still falling within the inventive scope of the present invention. For example, it is possible, instead of the sensors 33 and 35, which are embodied as proximity switches, to also use other sensors, such as light barriers, solenoid switches, etc, with the sensors 33 and 35 advantageously being stationary relative to the rotor 1, so that for a plurality of bell-shaped portions 8, it is necessary to have only an extremely small number of sensors, namely for the described embodiment, only the sensor 33 and possibly also the further sensor 35, with signal lines to the individual bell-shaped portions 8 not being necessary. If with the filling machine several processing phases at an overpressure in the bell-shaped portions 8 are provided, it is of course also possible to dispose several sensors 33 at the pertaining angular positions. It is of course possible to monitor with the pressure gauges 10, and with the sensor 33 or further corresponding sensors, not only the pressure of steam in the closed bell-shaped portions 8, but also the pressure of some other medium, such as a pressurizing gas.

In the illustrated embodiment, the ring 26 is merely placed upon the stem 22, i.e. the portion 22'' thereof, and is not fixedly connected with the stem. In this way, it is possible to shift the stem 22 out of the starting position illustrated in FIG. 3 and shift this stem further to the left, i.e. to shift the surface 28 further into the interior of the bell-shaped portion 8, without the compression spring 25 becoming effective. In this way, it is possible to invert the diaphragm 20, and hence to stretch it, into the interior of the bell-shaped portion 8, thereby resulting, among other things, in an improved possibility for cleaning not only that surface of the diaphragm 20 that faces the interior of the bell-shaped portion 8, but also the surface 28 of the stem 22.

The present invention is, of course, in no way restricted to the specific disclosure of the specification and drawings, but also encompasses any modifications within the scope of the appended claims.

What I claim is:

1. An arrangement for monitoring the filling elements of a filling machine that, for filling containers with a liquid filling material, has a plurality of such filling elements disposed on a rotating rotor, with each of said filling elements having a closeable bell-shaped portion for accommodating a container that is to be filled, with said bell-shaped portion being designed to operate at a processing pressure of a gaseous or vaporous medium, with said processing pressure being other than ambient pressure, said arrangement comprising:

a respective pressure gauge that is provided on each of said filling elements and is responsive to the pressure in the pertaining bell-shaped portion of said filling element; and at least one sensor, which cooperates with said pressure gauge to produce an electrical signal if said processing pressure in said bell-shaped portion deviates from said ambient pressure.

2. An arrangement according to claim 1, in which each of said filling elements has a housing, with said pressure gauge being provided on an element that is connected to said housing.

3. An arrangement according to claim 2, in which said element is said bell-shaped portion of said filling element.

4. An arrangement according to claim 1, in which said at least one sensor is disposed on a part of said filling machine that does not rotate with said rotor, with said at least one sensor being shared by said pressure gauges of all of said filling elements.

5. An arrangement according to claim 4, in which each of said pressure gauges has a control section that cooperates with said at least one sensor, wherein said control section of each pressure gauge assumes a first position relative to its pertaining filing element when ambient pressure prevails in said bell-shaped portion thereof, and assumes a second position relative to its pertaining filling element when a pressure that deviates from said ambient pressure prevails in said bell-shaped portion thereof.

6. An arrangement according to claim 5, in which said control section of said pressure gauge is moved out of said first position and toward said second position only when said pressure in said bell-shaped portion deviates from ambient pressure by a prescribed minimum value.

7. An arrangement according to claim 6, in which said control section moves out of said first position only when said pressure in said bell-shaped portion is at least 1.7 bar.

8. An arrangement according to claim 5, in which said at least one sensor is a switch that cooperates with said control section in a non-contact manner.

9. An arrangement according to claim 8, in which said at least one sensor is a proximity switch, and said control section is a trip cam that cooperates with said proximity switch.

10. An arrangement according to claim 5, in which said pressure gauge has an element that is responsive to pressure, with said control section being provided on said element; and which includes at least one spring, against the action of which said element is movable in response to said pressure in said bell-shaped portion that deviates from ambient pressure.

11. An arrangement according to claim 10, in which said control section is adjustably disposed on said element of said pressure gauge.

12. An arrangement according to claim 10, in which said element of said pressure gauge is a piston having a piston surface upon which said pressure in said bell-shaped portion acts.

13. An arrangement according to claim 10, in which said element of said pressure gauge is a stem that is displaceable along a longitudinal axis thereof against the effect of said at least one spring, with said stem having a first end that is disposed in a space that is subjected to said pressure that prevails in said bell-shaped portion, and with said stem having a second end that extends out of said space in a sealed manner, with said control section being disposed at said second end of said stem.

14. An arrangement according to claim 13, which includes a diaphragm for sealing said second end of said stem from said first end thereof and from said space.

15. An arrangement according to claim 13, in which said space that receives said first end of said stem is the interior of said bell-shaped portion.

16. An arrangement according to claim 13, which includes a slide sleeve that is disposed in housing means of said pressure gauge, with said stem being guided in said slide sleeve such that said stem is displaceable in a longitudinal direction thereof.

17. An arrangement according to claim 16, in which said at least one spring is a compression spring that surrounds a portion of the length of said stem and preloads said stem in a starting position that corresponds to said first position of said control section, with said spring having a first end that acts upon said stem and a second end that acts upon a surface of said housing means of said pressure gauge.

18. An arrangement according to claim 17, in which said first end of said spring acts against a ring that is freely displaceably disposed on said stem, with said housing means having a first abutment surface for said ring against which that side of said ring that is remote from said spring rests when said spring is relaxed and with said stem having a second abutment surface for that side of said ring that is remote from said spring.

19. An arrangement according to claim 18, in which said first abutment means of said housing means is provided on said slide sleeve.

20. An arrangement according to claim 13, in which said space that receives said first end of said stem is a space that directly communicates with the interior of said bell-shaped portion via an opening thereof.

* * * * *